US008276498B1

(12) United States Patent
Hannibal et al.

(10) Patent No.: US 8,276,498 B1
(45) Date of Patent: Oct. 2, 2012

(54) BALLISTIC SHIELD SYSTEM

(75) Inventors: Alan J. Hannibal, Fairview, PA (US); Kurt Gunther, Erie, PA (US)

(73) Assignee: Composiflex, Erie, PA (US)

( * ) Notice: Subject to any disclaimer, the term of this patent is extended or adjusted under 35 U.S.C. 154(b) by 1448 days.

(21) Appl. No.: 11/890,928

(22) Filed: Aug. 8, 2007

(51) Int. Cl.
*F41H 5/08* (2006.01)

(52) U.S. Cl. ..... 89/36.07; 89/36.05; 89/36.06; 89/918; 89/926

(58) Field of Classification Search ..... None
See application file for complete search history.

(56) References Cited

U.S. PATENT DOCUMENTS

| | | | | | |
|---|---|---|---|---|---|
| 36,781 | A | * | 10/1862 | Hunter | 109/22 |
| 250,635 | A | * | 12/1881 | McLean | 52/306 |
| 418,396 | A | * | 12/1889 | Buck | 2/2.5 |
| 663,961 | A | * | 12/1900 | Donaldson | 114/13 |
| 1,093,587 | A | * | 4/1914 | McClure | 52/456 |
| 1,679,802 | A | * | 8/1928 | Allerheiligen et al. | 52/203 |
| 1,739,121 | A | * | 12/1929 | Brotz | 220/849 |
| 1,801,541 | A | * | 4/1931 | Colean | 52/428 |
| 1,875,864 | A | * | 9/1932 | Gibian | 52/782.2 |
| 2,009,960 | A | * | 7/1935 | Johnson | 52/483.1 |
| 2,020,702 | A | * | 11/1935 | Russell | 2/2.5 |
| 2,085,954 | A | * | 7/1937 | Churchill | 434/148 |
| 2,110,322 | A | * | 3/1938 | Calzavara | 109/81 |
| 2,132,547 | A | * | 10/1938 | Sohn | 52/506.08 |
| 2,298,874 | A | * | 10/1942 | Dennison et al. | 52/208 |
| 2,374,057 | A | * | 4/1945 | Watkins | 52/208 |
| 2,388,786 | A | * | 11/1945 | Knight et al. | 52/208 |
| 2,396,493 | A | * | 3/1946 | Comiskey, Sr. | 296/78.1 |
| 2,399,184 | A | * | 4/1946 | Heckert | 109/82 |
| 2,537,804 | A | * | 1/1951 | Watkins | 428/210 |
| 2,562,951 | A | * | 8/1951 | Rose et al. | 442/208 |
| 2,660,751 | A | * | 12/1953 | Falkenberg | 16/442 |
| 2,675,266 | A | * | 4/1954 | Comiskey, Sr. | 296/78.1 |
| 2,722,179 | A | * | 11/1955 | Belew | 109/19 |
| 2,861,021 | A | * | 11/1958 | Dietz et al. | 428/215 |
| 2,936,050 | A | * | 5/1960 | McLaughlin | 52/704 |
| 2,974,407 | A | * | 3/1961 | Barr | 29/428 |
| 3,370,302 | A | * | 2/1968 | Karlyn | 2/2.5 |
| 3,476,107 | A | * | 11/1969 | Matt, Jr. et al. | 128/869 |
| 3,745,938 | A | * | 7/1973 | Hathaway et al. | 109/49.5 |
| 3,801,152 | A | * | 4/1974 | Tims et al. | 296/78.1 |
| 3,885,072 | A | * | 5/1975 | Zibritosky | 428/38 |
| 3,942,598 | A | * | 3/1976 | Council | 180/6.5 |

(Continued)

FOREIGN PATENT DOCUMENTS

DE 3142635 A1 * 5/1983

(Continued)

OTHER PUBLICATIONS

The Dow Chemical Company, Designing With Thermoplastics, 1992, The Dow Chemical Company, Form No. 306-00630-301X SMG, pp. 1-118.*

(Continued)

*Primary Examiner* — Michael Carone
*Assistant Examiner* — Joshua Freeman
(74) *Attorney, Agent, or Firm* — Richard K Thomson

(57) ABSTRACT

A modular ballistic shield design includes a viewport which extends from a first lateral edge of the shield to the second lateral edge providing unobstructed viewing. The three modules are connected together in a manner enabling replacement of any particular damaged module. No fastener protrudes through to the front face in a region fronting the user.

18 Claims, 7 Drawing Sheets

U.S. PATENT DOCUMENTS 4,035,014 A * 7/1977 Sellers ..... 296/24.46
4,066,291 A * 1/1978 Hickman ..... 296/78.1
4,178,718 A * 12/1979 Laby ..... 49/411
4,379,584 A * 4/1983 Willey ..... 296/78.1
4,412,495 A * 11/1983 Sankar ..... 109/49.5
4,674,394 A * 6/1987 Martino ..... 89/36.05
4,773,695 A * 9/1988 Jones et al. ..... 296/77.1
4,822,657 A * 4/1989 Simpson ..... 428/69
5,000,106 A * 3/1991 Rheney ..... 114/66
5,241,703 A * 9/1993 Roberts et al. ..... 2/2.5
5,355,645 A * 10/1994 Farag ..... 52/235
5,392,686 A * 2/1995 Sankar ..... 89/36.05
D359,820 S * 6/1995 Thumb et al. ..... D29/100
5,449,542 A * 9/1995 Chiba et al. ..... 428/116
5,463,929 A * 11/1995 Mejia ..... 89/36.02
5,510,575 A * 4/1996 Weibler ..... 174/381
5,600,084 A * 2/1997 Gonzalez ..... 89/36.02
5,771,489 A * 6/1998 Snedeker ..... 2/2.5
5,834,124 A * 11/1998 Pease et al. ..... 428/430
5,850,052 A * 12/1998 Gabriel ..... 89/36.05
6,000,347 A * 12/1999 Madden, Jr. ..... 109/49.5
6,000,668 A * 12/1999 Mannick ..... 248/201
6,020,989 A * 2/2000 Watanabe ..... 359/288
6,131,524 A * 10/2000 Nepper, Sr. ..... 109/49.5
6,138,434 A * 10/2000 Demars et al. ..... 52/786.13
6,176,538 B1 * 1/2001 Lawson et al. ..... 296/78.1
6,216,417 B1 * 4/2001 Morin et al. ..... 52/786.1
6,234,554 B1 * 5/2001 Willey ..... 296/78.1
6,296,214 B1 * 10/2001 Mannick ..... 248/200
6,415,575 B1 * 7/2002 Thompson ..... 52/712
6,622,607 B1 * 9/2003 Miller ..... 89/36.07
6,735,921 B2 * 5/2004 Oberhofer et al. ..... 52/786.1
6,805,441 B1 * 10/2004 Loniak ..... 351/110
6,807,890 B1 * 10/2004 Fuqua ..... 89/36.02
6,986,934 B2 * 1/2006 Chen et al. ..... 428/195.1
7,040,062 B2 * 5/2006 Emek ..... 52/204.62
7,288,314 B2 * 10/2007 Jacobs et al. ..... 428/299.1
7,302,880 B1 * 12/2007 Elasic ..... 89/36.07
7,478,580 B1 * 1/2009 Parimi et al. ..... 89/36.13
7,493,844 B2 * 2/2009 Martin ..... 89/36.07
7,520,207 B1 * 4/2009 Fuqua et al. ..... 89/36.07
8,001,880 B2 * 8/2011 White et al. ..... 89/36.04
2001/0027848 A1 * 10/2001 Mullet et al. ..... 160/271
2002/0027370 A1 * 3/2002 Kurohori et al. ..... 296/79
2002/0184839 A1 * 12/2002 Emek ..... 52/202
2003/0167911 A1 * 9/2003 White ..... 89/36.07
2003/0205012 A1 * 11/2003 Garcia ..... 52/313
2004/0040232 A1 * 3/2004 Memari et al. ..... 52/204.5
2005/0166496 A1 * 8/2005 Farag ..... 52/204.57
2005/0217472 A1 * 10/2005 Baker ..... 89/36.06
2005/0235819 A1 * 10/2005 Long ..... 89/36.07
2006/0005482 A1 * 1/2006 Bennison et al. ..... 52/204.5
2006/0016133 A1 * 1/2006 Speck ..... 52/79.1
2006/0165494 A1 * 7/2006 Olson ..... 405/258.1
2006/0213139 A1 * 9/2006 Stramandinoli ..... 52/384
2007/0114939 A1 * 5/2007 Joseph et al. ..... 313/623
2007/0131103 A1 * 6/2007 McClellan et al. ..... 89/37.03
2007/0193441 A1 * 8/2007 Carter ..... 89/36.07
2009/0100997 A1 * 4/2009 Fuqua et al. ..... 89/36.02

FOREIGN PATENT DOCUMENTS

DE 3217949 A1 * 11/1983
DE 4121656 A1 * 1/1993
GB 2035521 A * 6/1980
GB 2259925 A * 3/1993

OTHER PUBLICATIONS

Bayer, Engineering Polymers Joining Techniques a Design Guide, 2001, Bayer, KU-GE1030 Copyright © 2001, Bayer Corporation Printed in U.S.A. 5241 (7.5M) Mar. 2001, pp. 1-36.*

Analysis of tongue and groove joints for thick laminates,Karel Matous, George J. Dvorak, Department of Mechanical, Aerospace, and Nuclear Engineering, Centre for Composite Materials and Structures, Rensselaer Polytechnic Institute, Troy, NY 12180-3590, USA Received Sep. 19, 2003; accepted Jan. 11, 2004 Available online Jun. 9, 2004, Pages ALL.*

GE Plastics, GE Engineering Structural Foam Design & Processing Guide, GE Plastics, 1999, SFR-55 (May 1999) CA, pp. ii-7-6.*

* cited by examiner

BALLISTIC SHIELD SYSTEM

BACKGROUND AND SUMMARY OF THE INVENTION

The present invention is directed to the field of portable ballistic shield systems. More particularly, the present invention is directed to a modular ballistic shield with improved visibility, and reduced through bolts to minimize/eliminate the possibility of impact-induced shrapnel.

The ballistic shields currently available have a number of limitations. First, many utilize fasteners to attach the components together that extend through the components to the face of the shield. Such fasteners represent a weak point in the shield which may permit a bullet to penetrate, defeating the shield. Alternatively, the bolts can themselves become fragments, shrapnel, if you will, on the "protected" side of the shield. Another problem with some shields that employ adhesives to assemble components is that should one of the components become damaged and need replacement, the entire shield must be replaced since disassembly would destroy the otherwise non-damaged components. All of the commercially available shields have limited width view ports which impede the vision of the enforcement officer requiring her/him to move the shield laterally or to rotate her/his body to increase her/his field of view, both of which can expose her/him to the line of fire.

The present invention is directed to a ballistic shield for use in law enforcement, military operations, and crowd control, the shield comprising a first laminated composite section having a first lateral edge, a second lateral edge, a top edge, a bottom edge, a front face and a rear face, the first laminated composite section providing ballistic protection for a torso and legs of a person utilizing said shield; a ballistically protective viewport having a front face, a rear face, a top edge, a bottom edge, a first lateral edge and a second lateral edge, said viewport being attached to said top edge of said first laminated composite section and extending uninterruptedly from said first lateral edge to said second lateral edge of said first section facilitating unobstructed viewing; a second laminated composite section having a first lateral edge, a second lateral edge, a top edge, a bottom edge, a front face and a rear face, the second laminated composite section being attached to a top edge of the ballistically protective viewport extending uninterruptedly from the first lateral edge to the second lateral edge of the second section for protecting the head of the person utilizing the shield.

Most preferably, the bullet-proof viewport is made of polycarbonate and is connected to the first and second laminated composite sections without any fasteners extending through the front faces thereof in the region immediately in line with the user's body. In a first embodiment, the means to attach the viewport to the laminated sections includes a minimal number of through bolts positioned at the outer edges of the sections.

A handle is attached to the rear face of the first section such that no fastener extends through the first section to the front face. The handle includes two downwardly angled end portions to facilitate gripping the handle by either hand. A further feature of the ballistic shield of the present invention is a cutout in each of the first and second lateral edges permitting a user to extend an arm around the respective lateral edge to facilitate aiming a weapon. The contour of the shield may be flat, partially curved, fully curved and combinations thereof. The shield has a structure selected from a group consisting of solid, semi-solid and composite materials and may be constructed of a ballistic material selected from a group consisting of aramid fibers and long-chain polyethylene fibers, ceramics, and combinations thereof.

It is another feature of the present invention where the means interconnecting the first module to the second module and the second module to the third module does so in a manner permitting disassembly of the modules without damaging any of the modules, whereby when one of the modules becomes damaged, it may readily be replaced.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
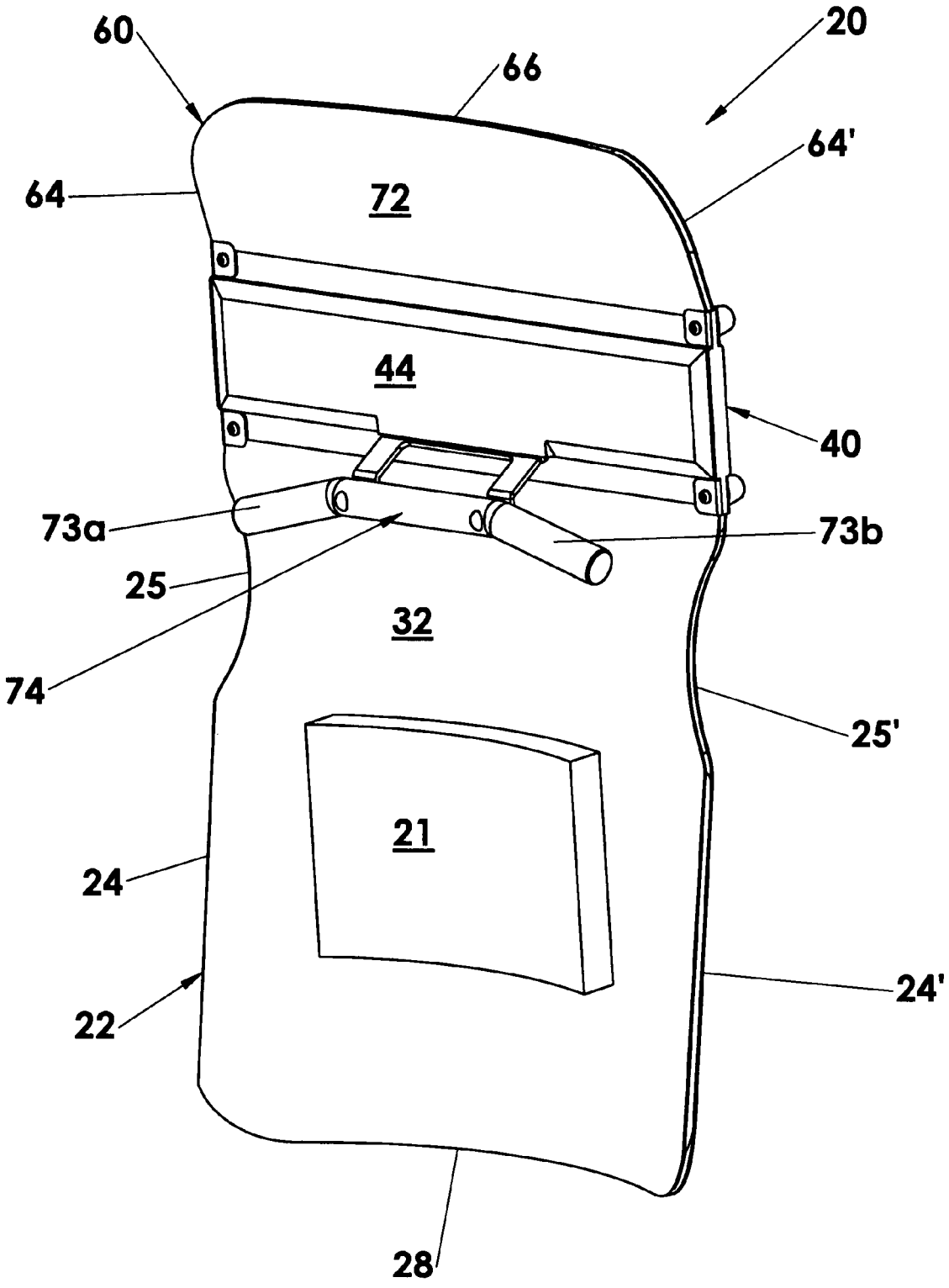
FIG. 1 is a perspective rear view of a first embodiment of the ballistic shield of the present invention.
Figure 2:
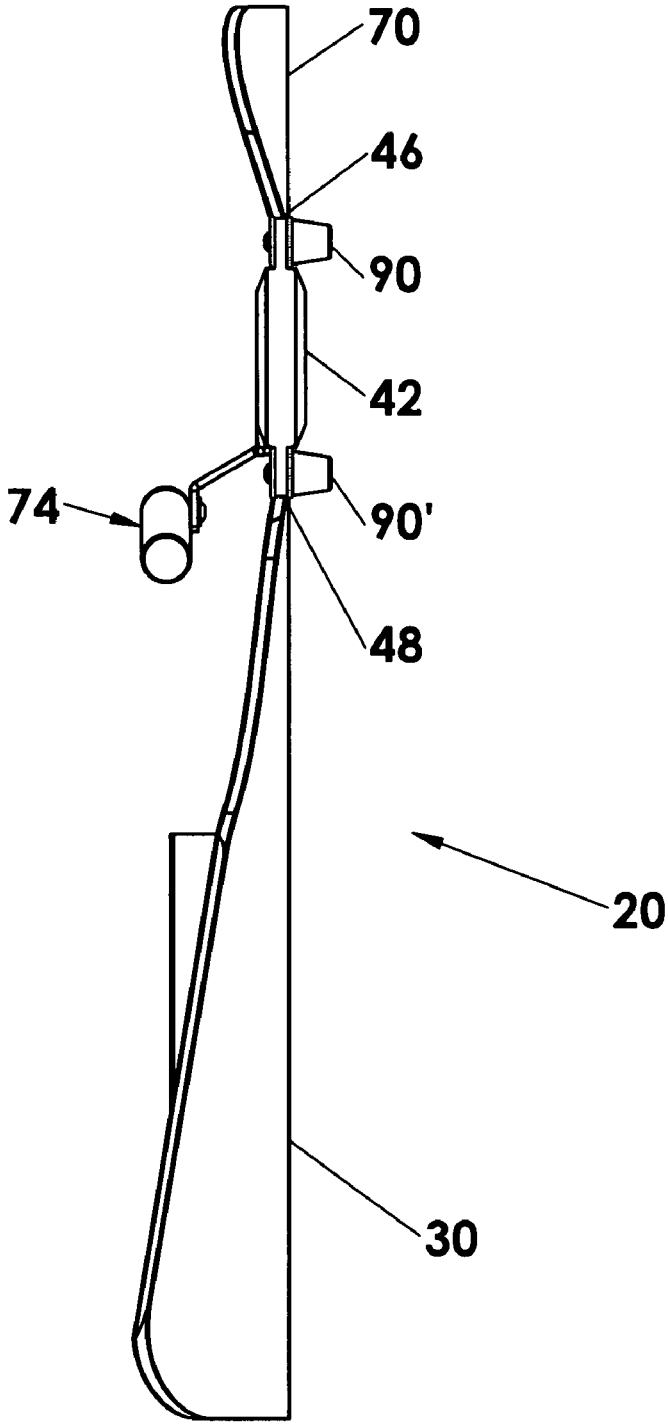
FIG. 2 is a side view of the first embodiment.
Figure 3:
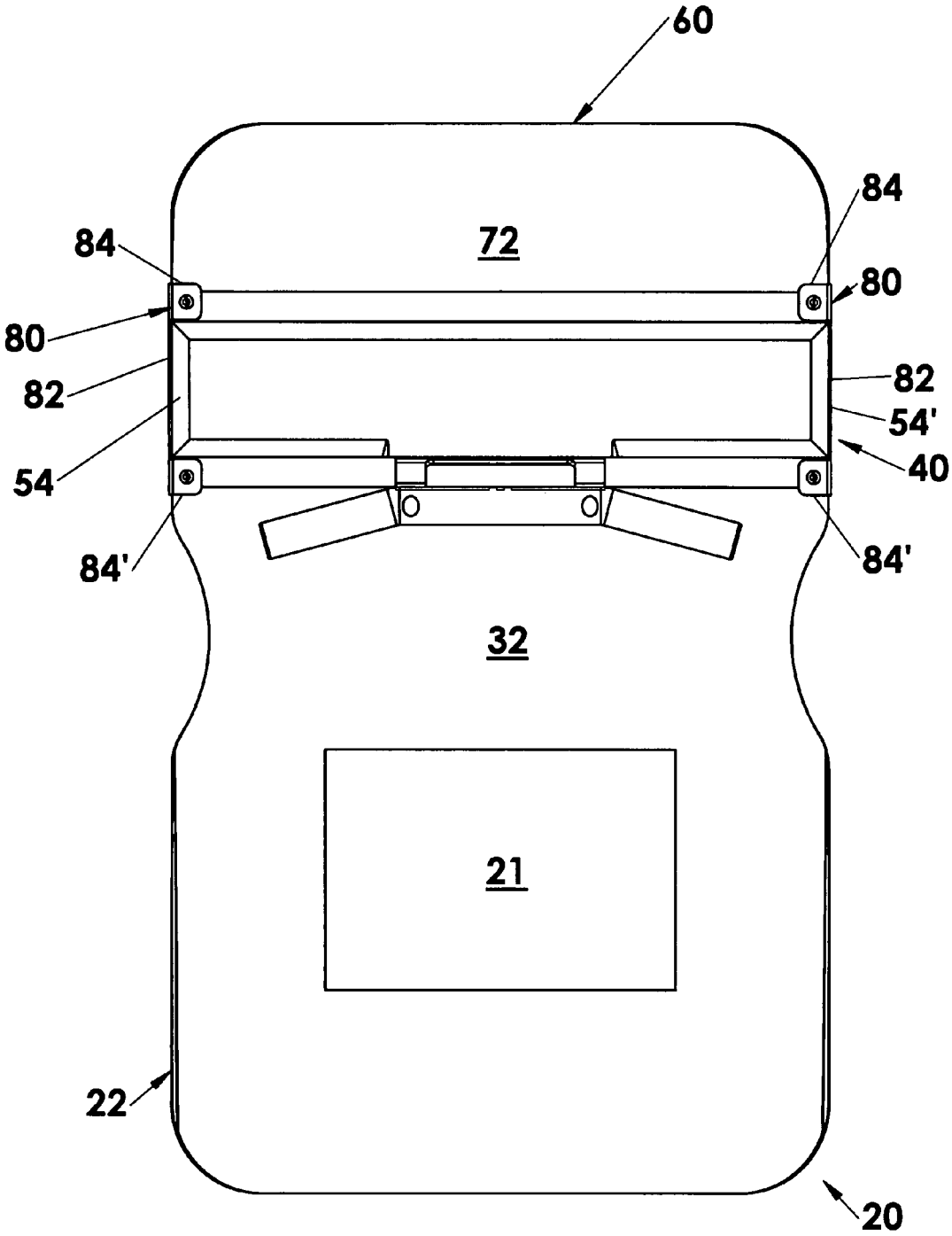
FIG. 3 is a rear view of the first embodiment.
Figure 4:
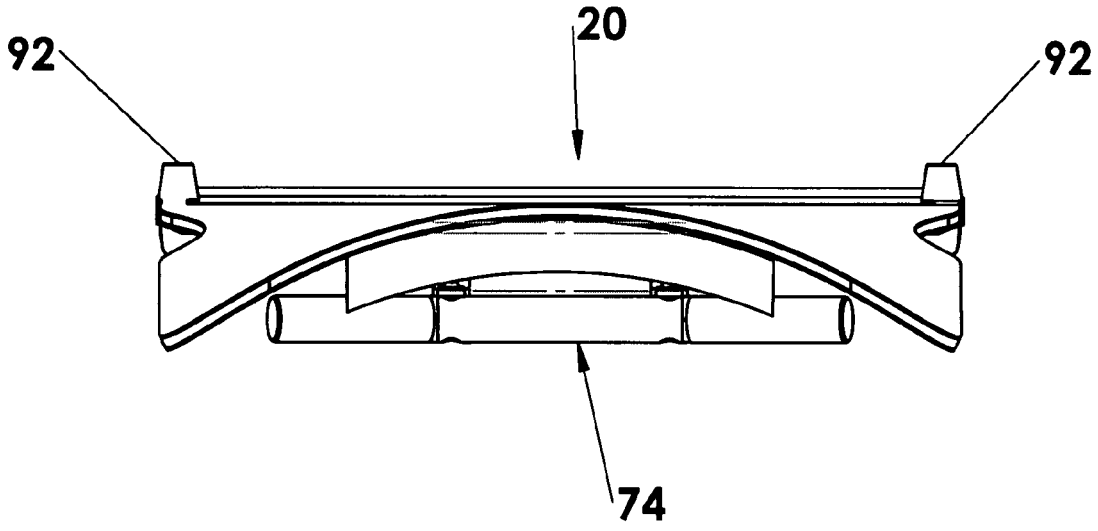
FIG. 4 a top view of the first embodiment.
Figure 5:
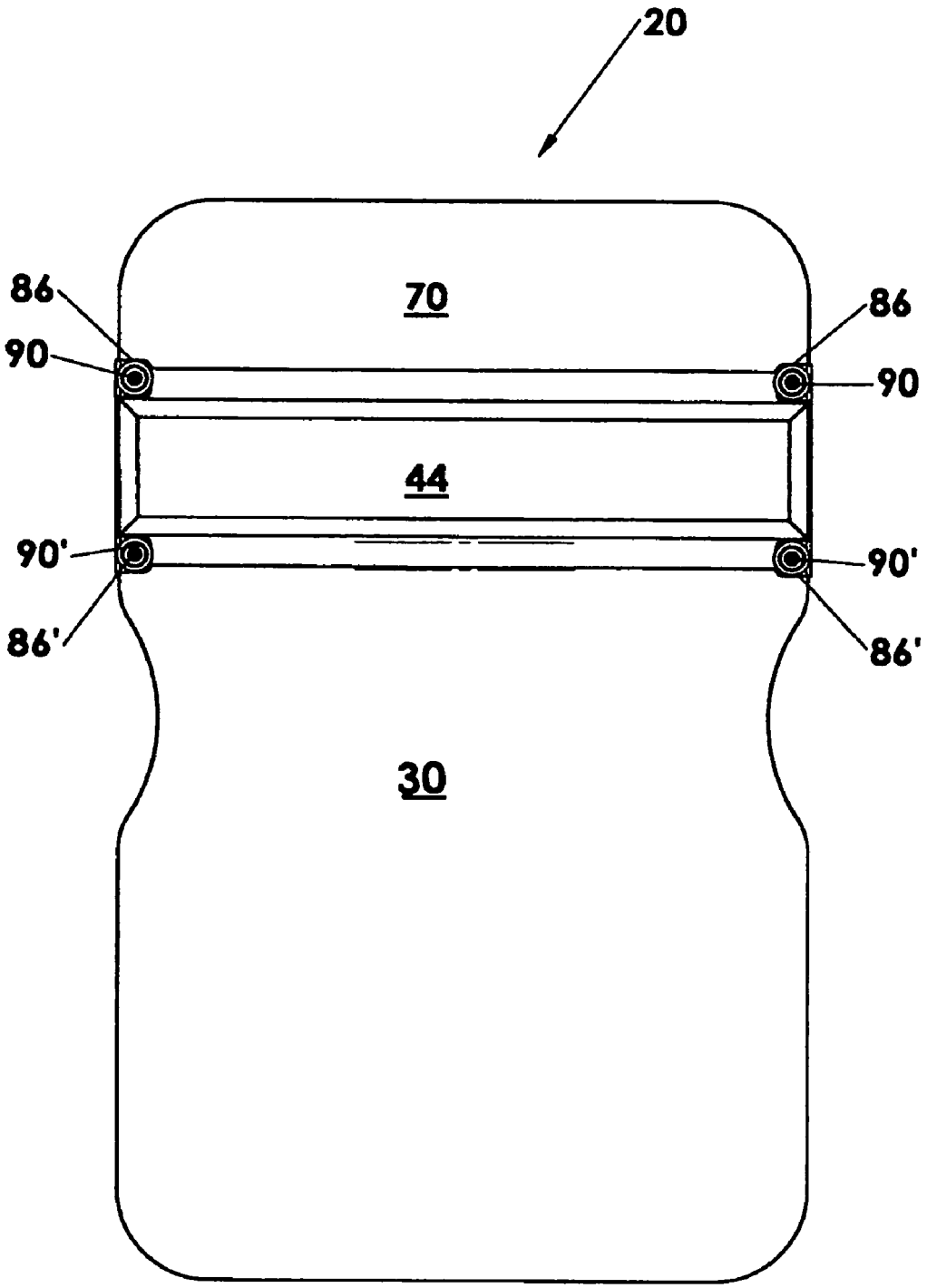
FIG. 5 is a front view of the first embodiment.

A first embodiment of the modular ballistic shield of the present invention is depicted generally in FIGS. 1-5 at 20. Modular ballistic shield 20 comprises three modules: a first module is formed by laminated composite section 22, second module is a ballistically protective viewport 40, and the third module is a second laminated composite section 60. First composite section 22 has a first lateral edge 24, a second lateral edge 24', a top edge 26 (FIG. 6), a bottom edge 28, a front face 30 and a rear face 32, the first laminated composite section 22 providing ballistic protection for a torso and legs of a person utilizing the shield 20. Foam pad 21 is adhered to rear face 32 allowing the user to hold the shield adjacent her/his forearm such that the foam pad 21 will absorb the impact of a projectile.

Ballistically protective viewport 40 has a front face 42 (FIG. 2), a rear face 44, a top edge 46, a bottom edge 48, a first lateral edge 54 (FIG. 3) and a second lateral edge 54'. A first cutout 25 in first lateral edge 24 enables a left-handed user to extend a handgun around shield 20 without exposing remaining body portions while a second cutout 25' in second lateral edge 24' affords the same capability for a right-handed user. The viewport 40 is attached to top edge 26 of first section 22 and extends uninterruptedly from first lateral edge 24 to second lateral edge 24' of first section 22 facilitating unobstructed viewing by a single user, or for simultaneous use by multiple enforcement personnel.

Second composite section 60 has a first lateral edge 64, a second lateral edge 64', a top edge 66, a bottom edge 68 (FIG. 6), a front face 70 and a rear face 72. Second laminated composite section 60 is attached to top edge 46 of viewport 40, and extends uninterruptedly from first lateral edge 54 (FIG. 3) to second lateral edge 54' of viewport 40 for protecting a head of the person utilizing shield 20. First laminated composite section 22 and second laminated composite section 60 each have a structure selected from a group consisting of solid, semi-solid and composite materials, preferably one selected from the group consisting of aramid fibers and long-chain polyethylene fibers, ceramics, and combinations thereof.

Figure 6:
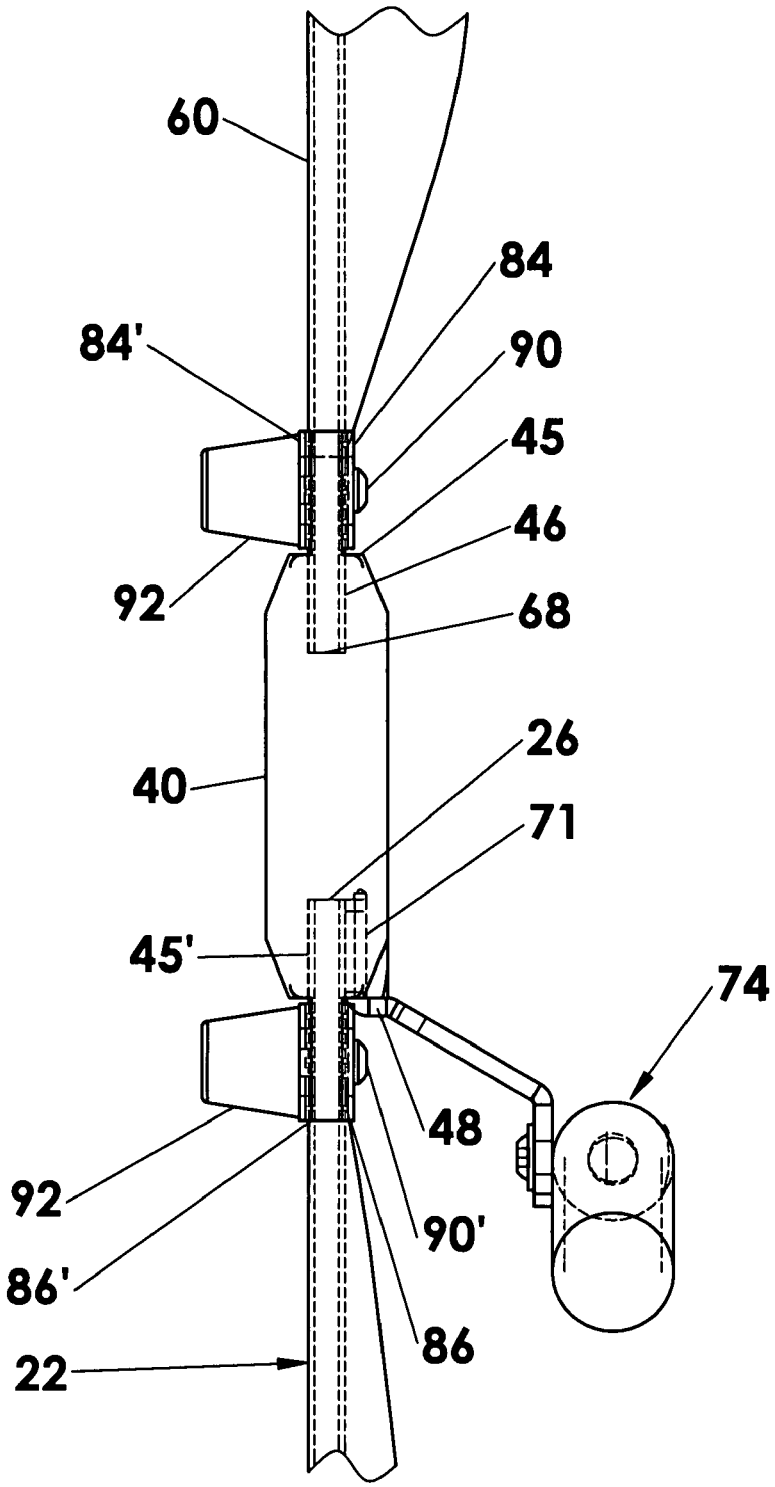
FIG. 6 is a detail side view showing the fastening system of the first embodiment; and, FIG. 7 is a detail side view of a second embodiment depicting an alternative fastening system.

The manner of assembly of sections 22, 40 and 60 is best depicted in FIG. 6. Upper edge 46 of viewport 40 has a slot 45 formed therein which receives bottom edge 68 of composite section 60. While the slot 45 is formed to tightly receive bottom edge 68, most preferably, an adhesive is utilized to ensure engagement between sections 40 and 60. Slot 45' is formed in lower edge 48 receives upper edge 26 of composite section 22 and, once again, an adhesive is preferably used to maintain engagement between sections 22 and 40. The center region of slot 45' (see FIG. 3) is wider so as to accommodate securement flange 71 of handle 74. The bevel extending around the balance of viewport 40 is discontinued in this central region to increase the material holding flange 71 in place.

Handle 74 has a first portion 73*a* bent downwardly for engagement by the right hand of a left-ended user to better accommodate the natural angle of the arm in supporting shield 20 in an upright position. Similarly, handle portion 73*b* is bent downwardly for engagement by the left hand of a right-handed user.

Securement clamps 80 each have a web 82 which extends along the outer edges 54, 54' and one pairs of ears, 84 and 86 which extend over portions of outer and inner surfaces 70, 72, respectively, of composite section 60 and a second pair of ears 84' and 86' which extend over portions of front and rear faces 30, 32, respectively, of composite section 22. Securement bolts 90 extend through holes (not shown) in ears 84, 86 and composite section 60 and securement bolts 90' extend through ears 84', 86' and composite section 22. Elastomeric bumpers 92 are secured in position by securement bolts 90, 90' and serve to protect the front face 42 of viewport 40 from scratching should the ballistic shield 20 be dropped or fall. In addition, it is noted that these securement bolts 90, 90' do not extend in a region immediately fronting the user. In one preferred embodiment, an adhesive is the primary means of maintaining sections 22, 40 and 60 as a unit with the securement clamps 80 serving as a mechanical backup to ensure that in the heat of battle, should a jarring of the shield 20 result in the adhesive letting loose, the sections 22 and/or 60 will not become dislodged from the viewport 40.

In a second embodiment, securement clamps 80 serve as the only means of maintaining the modules of the shield 20 together. In this embodiment the component parts 22, 40, 60 may be disassembled by removing securement bolts 90, 90', and any damaged part replaced, rather than having to discard the entire shield 20, as is currently the practice.

Figure 7:
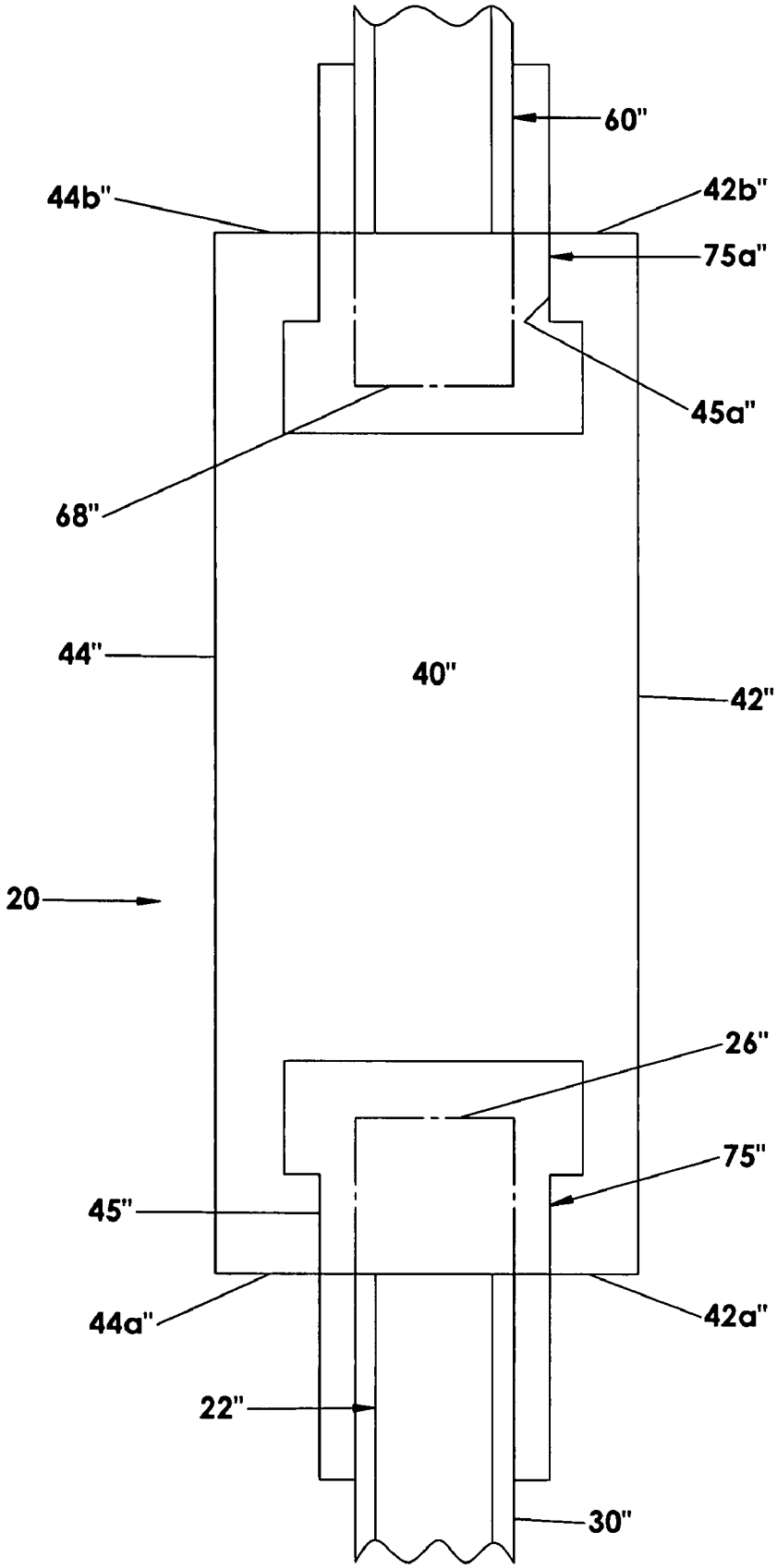

A third embodiment is shown in FIG. 7 in which the adhesive securing first laminated composite section 22" to bottom edge 48" of viewport 40" and second laminated composite section 60" to top edge 46" viewport 40" is replaced by first and second mechanical interlocks 75", 75*a*", respectively. First mechanical interlock 75" is used to interconnect viewport 40" to first composite section 22". Mechanical interlock 75" is placed on top edge 26" of first laminated composite section 22" and then slid laterally into slot 45" in the bottom edge 48" of viewport 40". The mechanical interlock is sandwiched between the a first wall 42*a*" adjacent front face 42" of viewport 40" and a second wall 44*a*" adjacent rear face 44". Walls 42*a*" and 44*a*" compress mechanical interlock 75" on top edge 26" of laminated composite section 22". This compressive force will be adequate to prevent undesired movement of mechanical interlock 75". Should further failsafe securement be desired, pins can be inserted through the joint area (without penetrating to the front face 42") or a securement clamp such as 80 utilized in the first embodiment may used here, as well.

Mechanical interlock 75*a*" is positioned on bottom edge 68" of second composite section 60" for receipt in slot 45*a*" in top edge 46" of viewport 40". Walls 42*b*" and 44*b*" compress mechanical interlock 75*a*" retaining bottom edge 68" of section 60" engaged in slot 45*a*". Other mechanical interlocks can be used without departing from the spirit of the invention. The key is that no fastener extends through the shield 20" to the front face 30" compromising the integrity of the shield.

Various changes, alternatives and modifications will become apparent to one of ordinary skill in the art following a reading of the foregoing specification. It is intended that any such changes, alternatives and modifications as fall within the scope of the appended claims be considered part of the present invention.

We claim:

1. A modular ballistic shield system for use in law enforcement, military operations, and crowd control, said shield comprising a) a first laminated composite section having a first lateral edge, a second lateral edge, a top edge, a bottom edge, a front face and a rear face, said first laminated composite section providing ballistic protection for a torso and legs of a person utilizing said shield;

b) a ballistically protective viewport having a front face, a rear face, a top edge, a bottom edge, a first lateral edge and a second lateral edge, said viewport being attached to said top edge of said first laminated composite section and extending uninterruptedly from said first lateral edge to said second lateral edge of said first section facilitating unobstructed viewing;

c) a second laminated composite section having a first lateral edge, a second lateral edge, a top edge, a bottom edge, a front face and a rear face, said second laminated composite section being attached to a top edge of said ballistically protective viewport and extending uninterruptedly from said first lateral edge to said second lateral edge of said viewport for protecting a head of the person utilizing said shield;

d) a handle attached to said rear face of said first section such that no fastener extends through said first section to said front face.

2. The ballistic shield system of claim 1 further comprising means to attach said ballistically protective viewport to said first and second laminated composite sections.

3. The ballistic shield system of claim 2 wherein said means to attach comprises a plurality of securement bolts near said lateral edges of said viewport.

4. The ballistic shield system of claim 3 wherein said means to attach comprises a slot formed in said upper and lower edges of said viewport.

5. The ballistic shield system of claim 4 wherein said means to attach further comprises an adhesive material in each said slot.

6. The ballistic shield system of claim 4 wherein said means to attach further comprises securement clamps which have ears extending over portions of both said first and second laminated composite sections which receive said securement bolts.

7. The ballistic shield system of claim 1 wherein said handle has a flange portion which is captured in a slot in said viewport.

8. The ballistic shield system of claim 1 wherein said handle includes two downwardly angled end portions to facilitate gripping said handle by either hand.

9. The ballistic shield system of claim 1 wherein a shape of said ballistic shield is selected from a group consisting of flat, partially curved, fully curved and combinations thereof.

10. A modular ballistic shield system for use in law enforcement, military operations, and crowd control, said shield comprising a) a first laminated composite section having a first lateral edge, a second lateral edge, a top edge, a bottom edge, a front face and a rear face, said first laminated composite section providing ballistic protection for a torso and legs of a person utilizing said shield;

b) a ballistically protective viewport having a front face, a rear face, a top edge, a bottom edge, a first lateral edge and a second lateral edge, said viewport being attached to said top edge of said first laminated composite section and extending uninterruptedly from said first lateral edge to said second lateral edge of said first section facilitating unobstructed viewing;

c) a second laminated composite section having a first lateral edge, a second lateral edge, a top edge, a bottom edge, a front face and a rear face said second laminated composite section being attached to a top edge of said ballistically protective viewport and extending uninterruptedly from said first lateral edge to said second lateral edge of said viewport for protecting a head of the person utilizing said shield;

whereby said shield has a structure selected from a group consisting of solid, semi-solid and composite and is constructed of a ballistic material selected from a group consisting of aramid fibers, long-chain polyethylene fibers, ceramics, and combinations thereof.

11. A ballistic shield system for use in law enforcement and crowd control, said shield system being of modular construction and comprising a) a first module of laminated composite constructed of a ballistic material selected from a group consisting of aramid fibers, long-chain polyethylene fibers, ceramics, and combinations thereof, said first module having a first lateral edge, a second lateral edge, a top edge, a bottom edge, a front face and a rear face, said first module providing ballistic protection for a torso and legs of a person utilizing said shield;

b) a second module constructed as a bullet-proof viewport having a front face, a rear face, a top edge, a bottom edge, a first lateral edge and a second lateral edge, said top, bottom and lateral edges forming edge portions, said second module being attached to said top edge of said first module;

c) a third module of laminated composite constructed of a ballistic material selected from a group consisting of aramid fibers, long-chain polyethylene fibers, ceramics, and combinations thereof, said third module having a first lateral edge, a second lateral edge, a top edge, a bottom edge, a front face and a rear face, said third module forming a second laminated composite section being attached to said top edge of said second module;

d) means interconnecting said first module to said second module and said second module to said third module in a manner permitting disassembly of said modules without damaging any of said modules;

whereby when one of said modules becomes damaged, it may readily be replaced.

12. The ballistic shield system of claim 11 wherein said means interconnecting said second module to said first module and said second module to said third module comprises connector means which does not have any securement bolts extending through said front faces thereof in a region immediately fronting a user.

13. The ballistic shield system of claim 12 wherein said connector means comprises a slot formed in at least one of said modules for receiving a portion of at least one of another of said modules.

14. The ballistic shield system of claim 13 wherein said connector means includes a slot in and upper and lower edge of said second module which receives one selected from a) a portion of said top edge of said first module and b) said bottom edge of said third module.

15. The ballistic shield system of claim 14 wherein said connector means comprises a plurality of securement bolts positioned adjacent said first and second lateral edges of said third module.

16. The ballistic shield system of claim 15 wherein said connector means further comprises a plurality of securement clamps extending along said edge portions of said viewport, said securement clamps having ears which overlap and are bolted to said first and third modules.

17. The ballistic shield system of claim 15 wherein said means for attaching further comprising an elastomeric bumper encapsulating each said securement bolt forming a bumper system, said bumper system protecting said viewport from scratching.

18. The ballistic shield system of claim 11 wherein said viewport is made of polycarbonate material.

* * * * *